US005147505A

United States Patent [19]

Altman

[11] Patent Number: 5,147,505

[45] Date of Patent: Sep. 15, 1992

[54] MULTILAYER PAPER AND METHOD FOR THE MANUFACTURING THEREOF

[75] Inventor: Thomas E. Altman, Yardley, Pa.

[73] Assignee: Union Camp Corporation, Wayne, N.J.

[21] Appl. No.: 705,219

[22] Filed: May 24, 1991

[51] Int. Cl.[5] ..... D21H 27/38

[52] U.S. Cl. ..... 162/129; 162/130; 162/149

[58] Field of Search ..... 162/9, 123, 129, 130, 162/149, 125

[56] References Cited

U.S. PATENT DOCUMENTS 4,436,587 3/1984 Andersson ..... 162/129
4,477,313 10/1984 Andersson ..... 162/123
4,781,793 11/1988 Halme ..... 162/129

*Primary Examiner*—Peter Chin
*Attorney, Agent, or Firm*—William K. Wissing

[57] ABSTRACT

Multilayer paper having an improved combination of stiffness and smoothness, and the processes for producing such paper products are disclosed. The multilayer papers are formed using chemical pulp, with the outer layers comprised of coarser, stronger fibers and the inner layer of finer but weaker fibers that exhibit a higher compressibility than the fibers of the outer layers. Such multilayer papers exhibit improved stiffness and strength from having the stronger fibers located in the outer layer, without losing the preferable surface smoothness of the finer inner-layer fibers, whose smoothness characteristics are reflected in the final surface smoothness.

17 Claims, No Drawings

MULTILAYER PAPER AND METHOD FOR THE MANUFACTURING THEREOF

BACKGROUND OF THE INVENTION

1. Field of the Invention

The present invention relates generally to multilayer paper products. More specifically, it relates to improved processes for producing multilayer papers having high surface smoothness coupled with improved stiffness.

2. Description of the Prior Art

The principal raw material used in paper manufacture is fiber derived from wood. The fibers are separated from the wood by a chemical or mechanical defiberizing process. The fibrous material obtained by the chemical method is generally called.chemical pulp, while the fibrous material produced mechanically is called mechanical pulp.

In a paper manufacturing process, the fibers are suspended in water to form a dilute fiber/water suspension that is then passed over a paper machine to form paper.

For most paper mills, the furnish of raw materials is economically limited to use of available woods within the immediately surrounding area. Many mills utilize both softwoods and hardwoods, the percentage of each used varying depending upon the mill's location. An additional reason for the use of fiber mixtures is that different fibers give the paper different properties. Thus, some fibers give the paper increased strength, while other fiber types may improve other properties, e.g., brightness, smoothness, opacity, or porosity. As a result, there are numerous fiber combinations used to manufacture the various kinds of paper.

Recently, the paper industry has encountered several serious problems. The cost of wood pulp has increased. In addition, the energy cost of paper manufacturing has been increasing. These circumstances have placed the paper industry and its customers in a situation of having to make a choice. Either the higher costs must be paid for, or fibers of lesser quality must be utilized. To avoid the higher costs while using present paper manufacturing techniques, some deterioration of the quality of the paper products resulted, in particular the printing properties. One response to these problems in the industry as a whole has been the development of multilayer production techniques. Multilayer techniques were first introduced in the production of paperboard. It was soon realized that this technique permitted the placing of different types of pulp in the different layers in order to optimize the usage of the different furnishes. Structured web forming is now an established concept for board and tissue products. For example, linerboard is manufactured in a two-layer structure. The motivation for this was economic—both low cost fibers and waste could be placed in the bottom sheet, while virgin fibers could be placed in the top sheet where appearance is important. Multilayer techniques, however, have not been developed for use in manufacturing fine printing grade papers.

As mentioned, such previous use of multilayer technology has been motivated by several considerations. The foremost consideration has been economics. Multilayer technology has been used to allow lower cost materials, such as chemithermomechanical pulps (CTMP) and waste, to be hidden in the inner layer. An additional advantage has been that property improvements have been realized by putting materials where they will be most advantageous to end use, rather than mixing them randomly. Another example of this is the improvement in stiffness that comes from putting a bulky middle layer between two layers of virgin chemical pulp. Use of multilayer techniques has also allowed the papermaker some extra degrees of freedom to separately treat the layers and achieve superior properties compared to what would be achieved if all of the furnish were uniformly processed.

Another example of multilayer technology is the segregation of hardwood and softwood in tissue to put the softer, hardwood pulp on the outside of the sheet where the consumer will touch it, and the stronger, softwood pulp in the inner layer.

The physical properties of multilayer paper can be divided into two categories. Some properties, such as tensile, tear, burst, density, and opacity, obey the law of mixtures and will be the same for sheets made either with a homogeneously mixed furnish or a three-layer structure with furnish components segregated. For these properties, there should be no intrinsic advantage to making a three-layer sheet. Other properties, however, such as bending stiffness, folding endurance, brightness, smoothness, surface compressibility, and printability, can be different in a three-layer sheet from what is observed in a sheet made from the same furnish homogeneously mixed and will affect the production of printing grade papers.

Bending stiffness increases can be obtained with a multilayer sheet when the weaker, lower density component is concentrated in the inner layer and the higher strength, higher density component is concentrated in the outer layers.

The prior art also teaches that the surface properties and printability of multilayer papers are determined by the outer-layer fibers. It is known that the smoothness and printability are directly related to a fiber property known as coarseness. Coarseness is a measure of weight per unit length, and it reflects the fiber diameter and cell wall thickness and density. The reciprocal of coarseness is sometimes referred to as fineness. Therefore, the coarseness or roughness of the fibers in the outer layer of a multilayer sheet has been generally predicted to determine the smoothness and printability of that sheet. See e.g., J. A. Bristow and N. Pauler, "Multilayer Structures in Printing Papers," 1983 SVENSK PAPPERSTIDNING R 164 at R 168–69. In Bristow and Pauler, multilayer sheets were manufactured using chemical pulp in certain layers and mechanical pulp in others. No particular tests were performed to examine the effects of using different types of raw materials as the starting material for a multilayer sheet made entirely from chemical pulp.

Compressibility can also affect printability properties. It has been seen that mechanical pulps are typically more compressible and that a multilayer structure, with the mechanical pulp in the outer layers and chemical pulp in the center layer, shows compressibility and printability more similar to an all-mechanical pulp sheet than to an all chemical pulp sheet.

As discussed earlier, the fiber furnish used in paper making is often composed of more than one fiber component. Thus, it is known that in multilayer technology improved stiffness can be realized, compared to a homogenous mixture, by putting the stronger, denser, higher modulus fibers in the outer layer, and the weaker, lower density pulp in the inner layer. In certain instances, the stronger fibers are also coarser than the weaker fibers in a particular furnish. When this occurs, according to the prior art observations and predictions, there is a property tradeoff: putting fibers that are stronger and coarser in the outer layer and fibers that are weaker and finer in the inner layer yields a multilayer sheet with improved stiffness, but with poorer smoothness and printability. Conversely, placing the finer (less coarse) fibers in the outer layer gives improved smoothness, but poorer stiffness. Thus, it appears that multilayer sheets made with high basis weights of coarse fibers in the outer layer have poor smoothness and printability. As a result of this strength/smoothness trade-off, there has been no incentive to manufacture printing papers in this manner.

This is true, particularly dealing with papers for letterpress and gravure printing, where surface smoothness is a critical concern. A more limited degree of smoothness is also required for the offset and flexographic processes in which a flexible printing form is used. Smoothness is required because the depressions in rough sheets are not covered with ink, resulting in either speckle in solid printed areas or a lack of definition in halftones. Many other attributes of print quality are important, but if a print has poor coverage, its other features will be largely ignored.

At the same time, the producers of printing papers have been challenged to produce smooth sheets at higher bulk. The trend to lighter basis weight papers has emphasized the need for high bulk in order to maintain stiffness. Nevertheless, these papers must still retain good smoothness characteristics in order to print well.

Technical advances in paper machine design have now made it possible to use multilayer structures not only in paperboard but also in thinner paper such as newsprint, fine papers and tissues. See e.g. J. A. Bristow and N. Pauler, "Multilayer Structures in Printing Papers," 1983 SVENSK PAPPERSTIDNING R 164, discussing the use of chemical and mechanical pulps in alternate layers.

In U.S. Pat. No. 4,781,793, issued to Halme, entitled "Method for Improving Paper Properties Using Long and Short Fiber Layers," there is disclosed a method for forming a sheet of paper with a predominance of long fibers in an outer surface and finer fibers in the center. The method which is disclosed is comprised of forming a base furnish and then separating the furnish into components, one of which contains a predominance of long fibers, but which also contains short fibers, and the other which contains a predominance of short fibers, but which still would contain long fibers, fillers and fines, etc. The use of the fiber mixtures, that is the long and short fiber components, is stated to help the retention and also to improve certain paper properties. The furnishes which are used are disclosed to be made of a chemical pulp for the short fibers and a mechanical pulp for the long fibers. While the layers may be different, each is to some extent a composite of both types of fibers, that is long and short fibers.

In U.S. Pat. No. 2,881,669, issued to Thompson et al., entitled "Paper or Board Products," there is described a paper or board product which is stated to have long fibers predominantly on opposite sides of a short fiber inner zone. This is stated to be accomplished as a result of the inherent drainage characteristics of the papermaking machine, wherein the long fibers tend to be retained when the papermaking machine forms the initial surface, and then the shorter fibers, and in addition long fibers, are also collected on the initial long-fiber layer. The resultant paper therefore has a graduated structure of predominantly long fibers at the outer surface and predominantly shorter fibers in the inner portion. The paper does not, however, have a definite multilayer structure with coarse fibers on the outer surface and fine fibers in the interior.

Another patent, U.S. Pat. No. 4,888,092, issued to Prusas et al., discloses a three-ply sheet, wherein the outer plies are made up of fines in order to improve surface smoothness.

Nevertheless, the problem of overcoming the tradeoffs between strength and smoothness between various starting pulps remains. Accordingly, there exists a need for a method to produce products having improved stiffness characteristics while maintaining high quality smoothness and printability characteristics.

SUMMARY OF THE INVENTION

The present invention is directed to multilayer paper product and processes for producing the multilayer paper products having an improved combination of stiffness and smoothness. To this end, multilayer papers having outer layers of coarser, stronger fibers and an inner layer of finer but weaker fibers that exhibit a higher compressibility than the fibers of the outer layers are formed from chemical pulp.

Such a multilayer paper exhibits improved stiffness and strength from having the stronger fibers located in the outer layer without losing the preferable surface smoothness of the finer inner-layer fibers.

DETAILED DESCRIPTION OF A PREFERRED EMBODIMENT

The present invention recognizes the surprising result that the use of coarse fibers in the outer layer of a multilayer paper can still result in the production of smooth paper products which predominantly have the smoothness characteristics of the fine-fiber inner layer. The present invention is based on forming a multilayer sheet from chemical pulp that meets several requirements. First, the outer layers of the sheets should be made of a first fibers which are coarser, stronger fibers than a second fibers which are used in the inner layer. Second, the fiber mat formed by the inner layer should have a higher compressibility than that formed by the outer layers.

It will be understood by a reading of the specifications, that a first fibers relates to those fibers, typically Southern Softwood Bleached Kraft Pulp fibers which are found in the outer layer, or first or second outer layers, or outer-layer component, as used herein. The second fibers relates to those fibers, typically Southern Hardwood Bleached Kraft Pulp fibers, which are found in the inner layer or inner layers, or second layer, or inner-layer component, as used herein. The first fibers have an average coarseness and strength which is greater than the average coarseness and strength of the second fibers.

In addition, the degree to which the outer-layer first fibers cover the inner layer may also affect the final paper characteristics. Thus, there is an upper limit to the basis weight of the coarse first fibers to be used in the outer layers that will still demonstrate the advantages of the present invention. This limit will depend upon the basis weight of the inner layer as well as upon other factors such as the fiber lengths used, the compressibility of the inner layer, etc.

For papers meeting these criteria, it has been surprisingly observed that the sheet's smoothness and printability is predominantly characterized by the properties of the inner-layer component, rather than those of the outer-layer component. This result is contrary to the prior art teachings and prevailing wisdom, which would have led one to expect just the opposite result.

Tests were conducted utilizing Southern Softwood Bleached Kraft Pulp (pine) and Southern Hardwood Bleached Kraft Pulp to prepare multilayer papers having only one of the two materials in each layer. These sheets were thereafter tested for letterpress smoothness (LSS). In this test, using the stated furnishes, the softwood was the coarser and stronger pulp in the sheet. For multilayer sheets having softwood outer layers, LSS tests were conducted wherein the softwood/hardwood/softwood basis weight ratios were set at 10/80/10, 20/60/20, 30/40/30, 40/20/40, 100% softwood and 100% hardwood. Basis weights of the outer layers ranged from 3 lb/3,000 $ft^2$ in a 10/80/10 paper to 35 lb/3,000 $ft^2$ in a 30/40/30 paper. When the LSS values for these various multilayer papers were compared to those predicted for pure softwood and for pure hardwood, the unexpected results shown were that, for the weights and ranges tested, all of the sheets with the coarser, stronger softwood in the outer layers exhibited a smoothness that was smoother than would have been predicted if pure softwood had been used. The thinner the outer layers and/or the thicker the inner layers, the more dominant were the smoothness characteristics of the inner layers on the final product. Similar trends were seen for other printability and smoothness tests, such as Parker-Print Surf (PPS), Sheffield Smoothness, and a profilometer test of roughness average.

Although not intending to be bound by any particular theory or explanation, it is nonetheless believed that part of the explanation for these surprising results lies in the higher compressibility of the inner layer as compared to the outer layers. Compression of the multilayer sheet during pressing and calendering acts to force the coarser fibers into the underlying layer of finer, more compressible fibers, in what can be described as a "beam-on-a-mattress" effect. As a result, while the stronger, coarser fibers, remain substantially at the surface to provide the sheet with extra stiffness, they are compressed into the finer-fiber layer. The finer fibers of the inner layer are thereby also present at the surface to provide smoothness characteristics.

As a corollary to this hypothesis, use of a minimal basis weight of finer fibers to form the outer layers should result in a multilayer sheet that still exhibits the smoothness characteristics of the finer fibers. In other words, use of a minimal basis weight of fine fibers or the use of any reasonable basis weight of coarser fibers to produce a multilayer paper sheet will both result in a sheet showing the smoothness characteristics of the finer fibers.

Support for this hypothesis was obtained from a simple experiment. Three types of sheets were made: 100% pine, 100% hardwood, and multilayer with 10% by basis weight pine outer layers and an 80% by basis weight hardwood inner layer. All sheets were prepared at a basis weight of 50 lb/3,000 $ft^2$, so that the multilayer sheet had 5 lb/3,000 $ft^2$ of pine in each outer layer, a regime where the process of the present invention readily operates.

Two types of measurements were taken on these sheets: bulk and profilometer roughness average. Each sheet was measured at three stages in the papermaking process: after forming, after pressing, and after calendering. The bulk of the hardwood was found to decrease much more than the bulk of the pine under the same pressing conditions. This is another way of saying that the hardwood has a much greater compressibility than the pine. The profilometer measurements were done on a Tencor P-1 Profilometer. The data showed that after forming and pressing, a multilayer sheet with pine in the outer layer still has the same roughness average as an all-pine sheet. After calendering, however, a multilayer sheet has the smoothness of the all-hardwood sheet. While this comparison of roughness average data did not compare the sheets at equivalent bulk, theoretical equations were generated that provided confirmation that the multilayer sheet should have the same smoothness as the hardwood sheet under these conditions.

The "beam-on-a-mattress" theory was further supported by the LSS and PPS tests, when performed on multilayer papers wherein the outer layers contained the hardwood fraction. Under these conditions, the smoothness of the final product continued to be dominated by the fineness of the hardwood fraction, with the coarser inner layer having little or no effect. According to the theory, this would be expected since the more compressible outer layer would simply cover over the coarser inner layer—a "mattress-on-a-beam."

The discovery of the present invention is commercially significant in that it allows the paper manufacturer to escape the traditional stiffness/smoothness trade-off predicted and previously observed for multilayer sheets while using many of the varieties of softwood/hardwood furnish that are currently available to integrated mills. With the discovery of the present phenomenon, a 50 lb/3,000 $ft^2$ sheet made with 10–15% Southern Softwood in each of the outer layers and 80–70% Southern Hardwood in the inner layer will have the same smoothness as a sheet made of 100% Southern Hardwood. Even so, because the Southern Softwood is stronger than the hardwood, this smooth sheet will also have improved stiffness characteristics compared to a homogeneously mixed sheet of the same overall composition and basis weight. In other words, the advantages of both smoothness and stiffness can be attained, rather than having to sacrifice one for the other.

While the present invention can be used advantageously in the manufacture of a wide variety of paper products, in generally preferred embodiments, fine papers are manufactured having a total basis weight of less than about 75 lb/3000 $ft^2$ with the basis weight of the inner layer being at least 15 lb/3000 $ft^2$ (such that each outer layer will be no more than 30 lb/3000 $ft^2$). Typical furnishes are made up of at least 50% hardwoods of the type that would be placed in the inner layer of the present invention when compared to the complimentary softwoods making up the rest of the furnish. As such, with an overall basis weight of 75 lb/3000 $ft^2$, the inner layer will having 18 lb/3000 $ft^2$ or less.

In addition, it is preferable that the less coarse inner layer material will be of such compressibility when compared to the material of the outer layer that it will end up densifying about twice as much as the surface layers. Nevertheless, the present invention is usable over a wide range of material compressibilities and compressibility differentials.

Further, while current testing has only involved three-layer paper products, there is no reason to think that the present invention could not be applied to multilayer products containing two layers or more than three layers. For such papers, the smoothness characteristics will be reflective of the inner layers that are immediately adjacent to the outer layers. In the case of a two-layer product, the paper sheet has a first layer comprised of a first fibers and a second layer comprised of a second fibers, which second layer is, immediately adjacent to the first layer and is more compressible than the first layer. The first fibers of the first layer have an average coarseness and strength which is greater than the average coarseness and strength of the second fibers of the second layer.

The effects of the present invention are equally applicable to two-layer paper products. In those cases, a first outer layer is immediately adjacent to a first surface of an inner layer, and a second outer layer is immediately adjacent to a second surface of the inner layer, which second surface is substantially parallel to the first surface. It is desired that the smoothness of the multilayer sheet be characterized by the surface smoothness of a sheet comprised entirely of the second fibers used in the second layer.

The effects of the present invention can be seen over a wide range of fiber coarsenesses, provided that a minimum average coarseness differential exists between the coarseness of the outer layers and that of the inner layer. Thus, the average coarseness of the outer layers will preferably be in the range of about 15–40 mg/100 m, with a most preferred average coarseness of about 22 mg/100 m. The average coarseness of the inner layer will preferably be between about 5–17 mg/100 m, with a most preferred average coarseness of about 12 mg/100 m. The average coarseness differential should preferably be at least 5 mg/100 m, with a more preferred average coarseness differential of at least 10 mg/100 m.

The process of the present invention preferably uses outer layers having basis weights up to about 30 lb/3,000 $ft^2$, although it appears that increased outer-layer basis weights can be used (such as 35 lb/3,000 $ft^2$) provided that sufficient inner-layer basis weights are also used in conjunction with such outer layers. In addition, while a wide range of inner-layer basis weights can be utilized, a preferred minimum basis weight for the inner layer is approximately 15 lb/3,000 $ft^2$.

Several uses and advantages of the process of the present invention can be readily envisioned. First, and most obviously, improved stiffness without loss of smoothness can be achieved with any chemical pulp furnish simply by changing from single-layer, homogeneous construction to a stratified or multilayer forming wherein coarser fibers are located in the outer layers. This technique would be especially valuable for certain paper grades, such as envelope.

Alternatively, not every paper product would directly benefit from increased stiffness. This increased stiffness, however, can be used to reap indirect, but significant, production efficiencies. Typically, the wet press pressure is regulated so that the paper exiting the wet press is not excessively thin so that it retains sufficient stiffness. When utilizing the process of the present invention, however, the paper will have a higher stiffness for the same thickness as would be observed in prior papers. Therefore, higher wet press pressures can be used on such a multilayer sheet, producing a thinner sheet that still has the same final stiffness as with previous papers, but a higher percentage of solids out of the web press. This ability to remove more water at the wet press translates into distinct productivity improvements. Less water will have to be removed in the drier and, ultimately, less energy will be required to produce the same amount of paper.

Still further, the increased stiffness exhibited in the multilayer sheets of the present invention can be used to produce a smoother sheet through an increase in calendering pressure. Much like the option discussed above as to the wet press, the calendering pressure can be increased to produce a slightly thinner final sheet that maintains the same stiffness as prior papers. The ability to increase calendering pressure will result in a smoother final sheet, as well as a savings in energy.

The advantages of increased wet press pressures and increased calendering pressures just discussed can also be combined to various degrees to optimize the entire manufacturing process, so long as the final desired stiffness is maintained.

Yet another advantage of the multilayer sheet of the present invention is the ability to disguise vessel segments that might detract from the overall quality of the paper being manufactured. As stated previously, in most furnishes, the softwood portion will be the coarser and stronger portion of the furnish and, in accordance with the present invention, would be used to form the outer layers. In some hardwood fractions, vessel segments are present that detract from the quality of the final product if appearing at the paper's surface. These vessel segments may pick out during a printing process. In the present inventive process, however, these vessel segments are placed in the inner layer and, therefore, do not appear at the paper's surface and will not be subject to picking.

Thus, processes for producing multilayer papers demonstrating improved strength and stiffness characteristics are disclosed, as are multilayer papers resulting from such processes. While the invention has been particularly shown and described with reference to preferred embodiments, many other uses and modifications of the methods of the invention will be apparent to those skilled in the art upon reading the specification, and many such modifications are possible without departing from the inventive concepts herein. The invention, therefore, is not intended to be limited except in the spirit of the appended claims.

What is claimed is:

1. The multilayer paper sheet made from chemical pulps, said sheet comprising a first layer comprised of a first fibers and a second layer immediately adjacent thereto comprised of a second fibers;

said first fibers having average coarseness at least 5 mg/100 m greater than the average coarseness of said second fibers;

said immediately adjacent second layer being more compressible than said first layer; and the surface smoothness of said multilayer sheet being predominantly characterized by the surface smoothness properties of said second layer.

2. A multilayer paper sheet made from chemical pulps, said sheet comprising a first outer layer and a second outer layer, said first and second outer layers comprised of a first fibers, and an inner layer disposed there between, said inner layer comprised of a second fibers and being more compressible than the first and second outer layers;

said first outer layer being immediately adjacent to a first surface of said inner layer, said second outer layer being immediately adjacent to a second surface of said inner layer, said second surface being substantially parallel to said first surface;

said first fibers having an average coarseness at least 5 mg/100 m greater than the average coarseness of said second fibers; and the surface smoothness of said multilayer sheet being predominantly characterized by the surface smoothness properties of said inner layer.

3. The multilayer paper sheet of claim 2 wherein the average coarseness of the first fibers of the outer layers is at least 10 mg/100 m greater than the average coarseness of the second fibers of the inner layer immediately adjacent to said outer layers.

4. The multilayer paper sheet of claim 2 wherein the first fibers of the outer layers have an average coarseness of 15–40 mg/100 m and the second fibers of the inner layer immediately adjacent thereto have an average coarseness of 5–17 mg/100 m, while the average coarseness of the first fibers of the outer layers is at least 5 mg/100 m greater than the average coarseness of the second fibers of the inner layer immediately adjacent to said outer layers.

5. The multilayer paper sheet of claim 2 wherein the first fibers of the outer layers have an average coarseness of about 22 mg/100 m and the second fibers of the inner layer immediately adjacent thereto have an average coarseness of about 12 mg/100 m.

6. The multilayer paper sheet of claim 2 wherein the basis weight of the multilayer sheet is no more than 75 lb/3000 $ft^2$ and the basis weight of said immediately adjacent inner layer is at least 15 lb/3000 $ft^2$.

7. The multilayer paper sheet of claim 2 wherein the basis weight of each outer layer does not exceed the basis weight of the immediately adjacent inner layer by more than 15 lb/3000 $ft^2$.

8. A multilayer paper sheet made from chemical pulps, said sheet having two outer layers comprised of a first fibers and one or more inner layers there between comprised of a second fibers;

said multilayer sheet having a basis weight of no more than 75 lb/3000 $ft^2$ and said one or more inner layers having a basis weight of at least 15 lb/3000 $ft^2$;

said first fibers of the outer layers having an average coarseness of 15–40 mg/100 m;

said second fibers of said one or more inner layers having an average coarseness of 5–17 mg/100 m while maintaining an average coarseness that is at least 10 mg/100 m less than the average coarseness of the first fibers of the outer layers;

said one or more inner layers being more compressible than said outer layers; and the surface smoothness of the multilayer sheet being predominantly characterized by the surface smoothness of a sheet comprised entirely of the second fibers used in said one or more inner layers.

9. A method of manufacturing a chemical pulp, multilayer paper sheet having one or more outer layer comprised of a first fibers and one or more inner layers immediately adjacent to said outer layers comprised of a second fibers, comprising the steps of:

manufacturing the outer layer or outer layers to contain the first fibers that have an average coarseness at lest 5 mg/100 m greater than the average coarseness of said second fibers of the inner layer or inner layers immediately adjacent thereto; and selecting said second fibers of said immediately adjacent inner layer or inner layers so that said immediately adjacent inner layer or inner layers are more compressible than said outer layer or outer layers.

10. The method of claim 9 further comprising the steps of selecting either the basis weight of each layer, the furnish used in each layer, or both so that the surface smoothness of the multilayer sheet is predominantly characterized by the surface smoothness of a sheet comprises entirely of the second fibers used in said immediately adjacent inner layer or inner layers.

11. The method of claim 9 wherein the first fibers of the outer layer or outer layers are selected to have an average coarseness that is at least 10 mg/100 m greater than the average coarseness of the second fibers of the inner layer or inner layers immediately adjacent to said outer layer or outer layers.

12. The method of claim 9 wherein the first fibers of the outer layer or outer layers are selected to have an average coarseness of 15–40 mg/100 m and the second fibers of the inner layer or inner layers immediately adjacent thereto are selected to have an average coarseness of 5–17 mg/100 m while the average coarseness of the first fibers of the outer layer or outer layers is at least 5 mg/100 m greater than the average coarseness of the second fibers of the inner layer or inner layers immediately adjacent to said outer layer or outer layers.

13. The method of claim 9 wherein the first fibers of the outer layer or outer layers are selected to have an average coarseness of about 22 mg/100 m and the second fibers of the inner layer or inner layers immediately adjacent thereto are selected to have an average coarseness of about 12 mg/100 m.

14. The method of claim 9 wherein the outer layer or outer layers are manufactured to each have a basis weight of less than 35 lb/3000 $ft^2$.

15. The method of claim 9 wherein the basis weight of the multilayer sheet is selected to be no more than 75 lb/3000 $ft^2$ and the basis weight of said immediately adjacent inner layer or inner layers is selected to be at least 15 lb/3000 $ft^2$.

16. The method of claim 9 wherein the basis weight of each outer layer is selected so that it does not exceed the basis weight of the immediately adjacent inner layer or inner layers by more than 15 lb/3000 $ft^2$.

17. The method of claim 9 wherein the smoothness of the immediately adjacent inner layer or inner layers is selected so as to produce a desired surface smoothness in the sheet.

* * * * *